US011465812B2

(12) United States Patent
Wu et al.

(10) Patent No.: US 11,465,812 B2
(45) Date of Patent: Oct. 11, 2022

(54) PATTING BAG STRUCTURE

(71) Applicant: CHANG YANG MATERIAL CO., LTD., Huatan Township (TW)

(72) Inventors: Jun Ju Wu, Huatan Township (TW); Ming Hua Huang, Huatan Township (TW); Lung Hsun Song, Huatan Township (TW); Dong Jhou Lee, Huatan Township (TW); Lin Chun Sun, Huatan Township (TW)

(73) Assignee: CHANG YANG MATERIAL CO., LTD., Huatan Township (TW)

( * ) Notice: Subject to any disclaimer, the term of this patent is extended or adjusted under 35 U.S.C. 154(b) by 67 days.

(21) Appl. No.: 16/596,517

(22) Filed: Oct. 8, 2019

(65) Prior Publication Data

US 2020/0115113 A1 Apr. 16, 2020

(30) Foreign Application Priority Data

Oct. 11, 2018 (TW) ..... 107213754

(51) Int. Cl.
*B65D 33/30* (2006.01)

(52) U.S. Cl.
CPC ..... *B65D 33/30* (2013.01)

(58) Field of Classification Search
CPC .... B65D 33/30; B65D 33/14; A45F 2005/008
USPC ..... 383/43, 905, 30, 31, 88–91, 82, 83, 85, 383/41; 224/409, 411, 401, 274, 407; 248/693, 311.2, 311.3, 312.1, 313; 220/475
See application file for complete search history.

(56) References Cited

U.S. PATENT DOCUMENTS 3,201,030 A * 8/1965 Pollack ..... B65D 75/52 383/43
3,251,390 A * 5/1966 Evans ..... A61M 3/0245 383/17
3,437,117 A * 4/1969 Vitello ..... B65D 33/14 383/22
3,545,668 A * 12/1970 Hultberg ..... B65D 75/5805 383/204
4,261,506 A * 4/1981 Scott ..... B65D 33/14 383/22
4,997,104 A * 3/1991 Pohl ..... B65D 33/1666 229/117.34
5,971,612 A * 10/1999 McAuslan ..... A45C 11/16 383/39
9,534,749 B2 * 1/2017 Dai ..... G02B 6/00
(Continued)

*Primary Examiner* — Jes F Pascua
*Assistant Examiner* — Nina K Attel
(74) *Attorney, Agent, or Firm* — Sheppard Mullin Richter & Hampton LLP

(57) ABSTRACT

A patting bag structure, which is furled when an external force is applied thereto, includes a bag body and at least one elastic furling element. The bag body includes an opening, a patting portion and a housing portion, wherein the patting portion is connected to the housing portion, and the opening is connected to the housing portion by the patting portion. The at least one elastic furling element is disposed on the patting portion of the bag body, wherein the at least one elastic furling element is furled when the external force is applied thereto, and the patting portion is furled together with the elastic furling element so as to disconnect the opening from the housing portion.

12 Claims, 9 Drawing Sheets

(56) References Cited

U.S. PATENT DOCUMENTS

| | | | | |
|---|---|---|---|---|
| 2004/0032994 | A1* | 2/2004 | Marschall | B65D 33/1658 383/43 |
| 2010/0258601 | A1* | 10/2010 | Thrope | A45C 1/00 224/267 |
| 2016/0174668 | A1* | 6/2016 | Script | A44B 18/0084 24/306 |

* cited by examiner

PATTING BAG STRUCTURE

RELATED APPLICATIONS

This application claims priority to Taiwan Application Serial Number 107213754, filed Oct. 11, 2018, which is herein incorporated by reference in its entirety.

BACKGROUND

Technical Field

The present disclosure relates to a bag structure. More particularly, the present disclosure relates to a patting bag structure.

Description of Related Art

In the recent society, the use of bags is very popular. The bags are widely used in supermarkets, vegetable markets, restaurants, and cold drink shops, etc., and have become indispensable in daily life.

The conventional bags have structures that can be classified into two types. One is bag structures having a hand-held portion and a bag body, and the other is bag structures having only a bag body. Although both of the aforementioned types of bag structures can be used to accommodate articles, other devices are needed so as to help the loading thereof. Thus, the convenience of the aforementioned bag is not insufficient. For example, a basket is needed so as to position the bag structure when a user is riding a bicycle. The transportation of the bag structure will become very difficult when the user is riding on a bike without a basket, especially to a bag structure without a hand-held portion. Furthermore, the opening of the conventional bag structure usually cannot be closed completely, so that the articles accommodated therein is easy to fall or leak out so as to cause inconvenience and dangerous situations to users.

SUMMARY

According to one aspect of the present disclosure, a patting bag structure capable of being furled when an external force is applied thereto, includes a bag body and at least one elastic furling element. The bag body includes an opening, a patting portion and a housing portion. The patting portion is connected to the housing portion, and the opening is connected to the housing portion by the patting portion. The at least one elastic furling element is disposed on the patting portion of the bag body, wherein the at least one elastic furling element is furled when the external force is applied thereto, and the patting portion is furled together with the elastic furling element so as to disconnect the opening from the housing portion.

According to another aspect of the present disclosure, a patting bag structure capable of being furled when an external force is applied thereto, includes a bag body and at least one elastic furling element. The bag body includes an opening, a patting portion and a housing portion, wherein the patting portion is connected to the housing portion, and the opening is connected to the housing portion by the patting portion. The at least one elastic furling element includes a patting section and a housing section, wherein the patting section is connected to the housing section, the patting section and the housing section are disposed on the patting portion and the housing portion, respectively, the patting section is furled when the external force is applied thereto, and the patting portion is furled together with the patting section so as to disconnect the opening from the housing portion.

According to further another aspect of the present disclosure, a patting bag structure capable of being furled when an external force is applied thereto, includes a bag body and at least one elastic furling element. The bag body includes an opening, a patting portion and a housing portion, wherein the patting portion is connected to the housing portion. The at least one elastic furling element is disposed on the patting portion of the bag body, wherein the at least one elastic furling element is furled when the external force is applied thereto, and the patting portion is furled together with the at least one elastic furling element so as to form a furling space, and the housing portion is located in the furling space.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
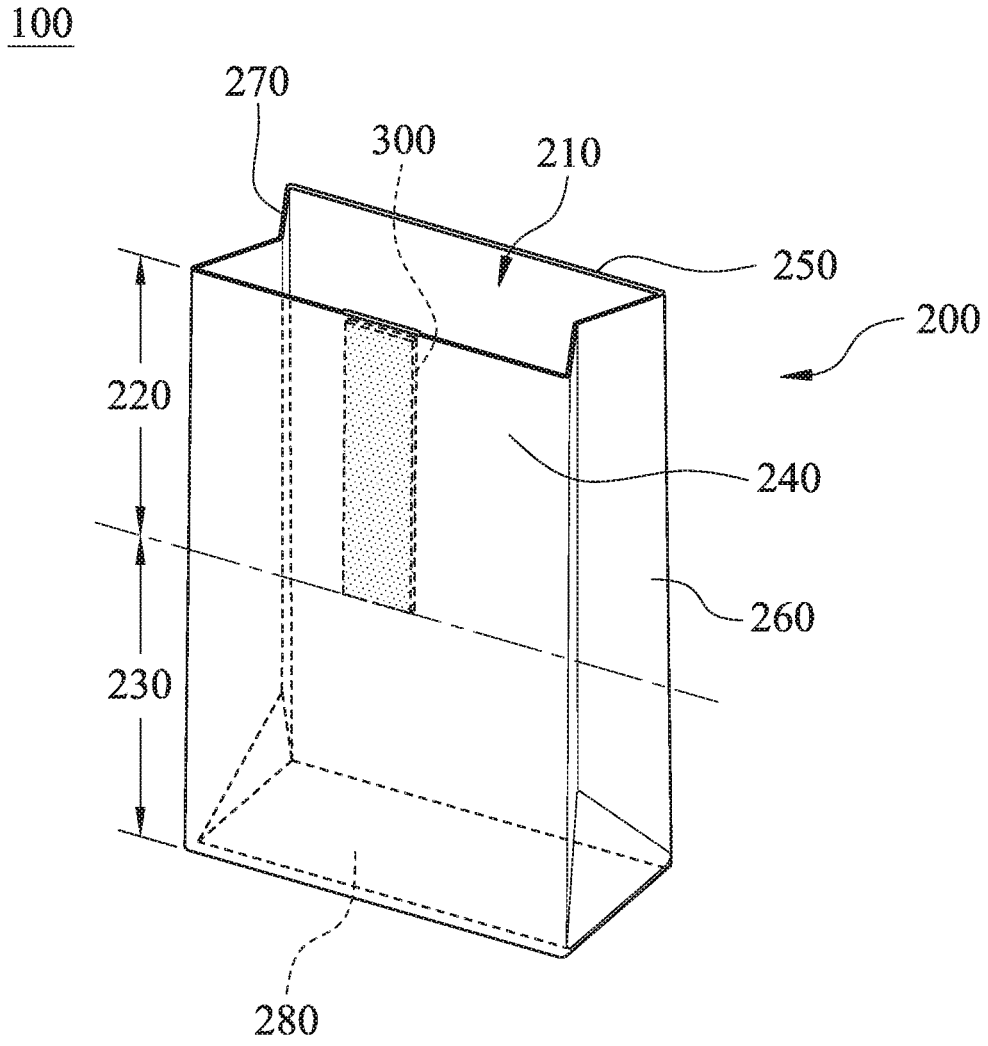
FIG. 1 is a perspective view of a patting bag structure according to one example embodiment of the present disclosure.

The present disclosure will be further exemplified by the following specific embodiments along drawings thereof so as to facilitate utilizing and practicing the present disclosure completely by the people skilled in the art without over-interpreting and over-experimenting. However, the readers should understand that the present disclosure should not be limited to these practical details thereof, that is, in some embodiments, these practical details are used to describe how to implement the materials and methods of the present disclosure and are not necessary. Furthermore, in order to simplify the drawings, some conventional structures and elements will be illustrated in a simple manner in the drawings, and the repeated elements may be represented by the same reference numerals.

Furthermore, in the present specification, when one element (or, structure and module) "is connected to", "is disposed on" or "is linked to" another element, it means the element can be directly connected to, disposed on or linked to another element or be indirectly connected to, disposed on or linked to another element (that is, there is an element disposed between the aforementioned element and another element). In other words, if an element is exactly illustrated as being "directly connected to", "directly disposed on" or "directly linked to" another element, there is without an element disposed between the aforementioned element and another element. Furthermore, the terms of "first", "second" and "third" are only for illustrating different elements or components and not used to limit the elements or components themselves. Thus, the first element/component can be named as the second element/component. Moreover, the combination of the elements/component/structures/modules described in the present specification are not well-known, conventional or common combination in the field, and it is hard for the person skilled in the arts to determine whether the combination relationship is obviousness or not based on the elements/components/structures/modules themselves are conventional or not.

Disclosed herein is a patting bag structure which is convenient for use, has a simple structure, and can be loaded without additional devices.

Figure 6:
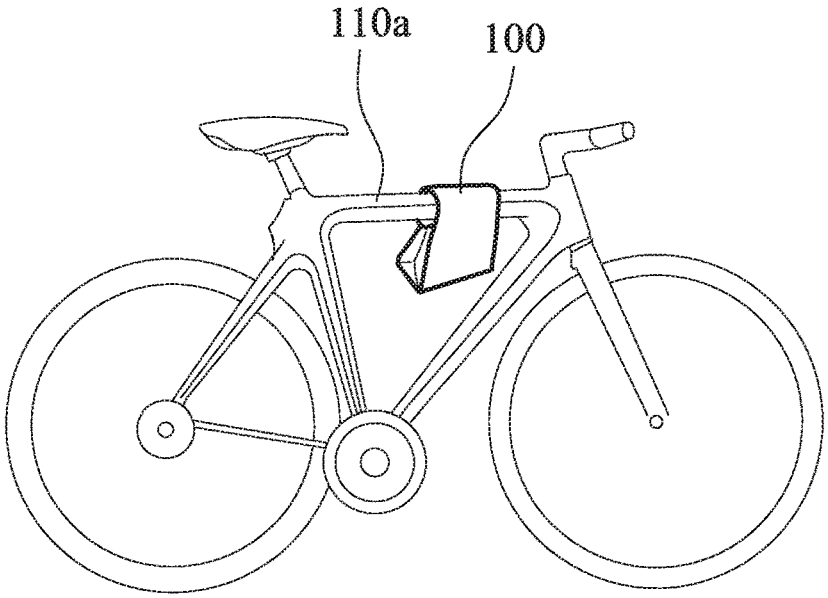
FIG. 6 is a schematic view of a patting bag structure connected to a first work element according to one example embodiment of the present disclosure.
Figure 7:
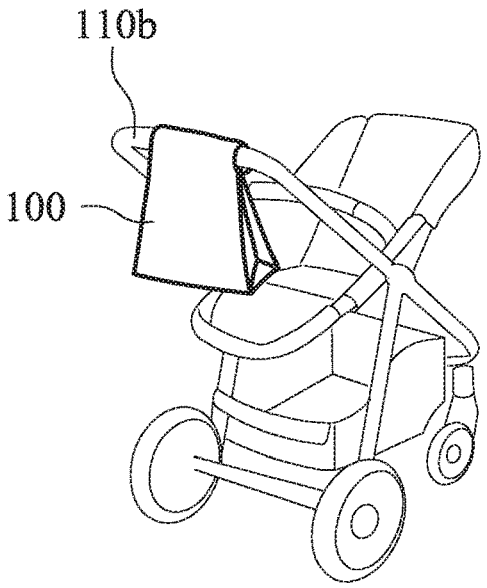
FIG. 7 is a schematic view of a patting bag structure connected to a second work element according to one example embodiment of the present disclosure.
Figure 8:
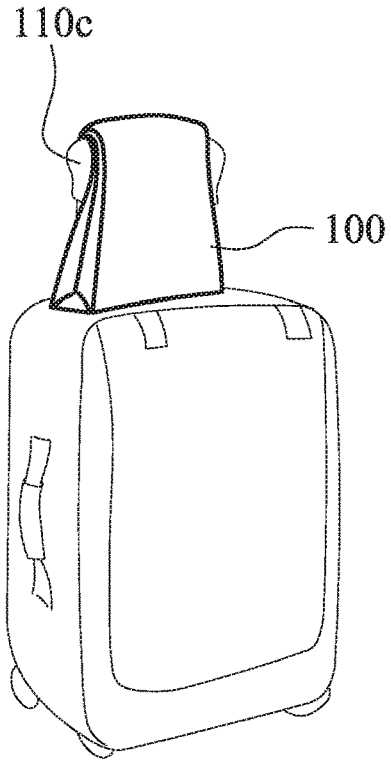
FIG. 8 is a schematic view of a patting bag structure connected to a third work element according to one example embodiment of the present disclosure.
Figure 9:
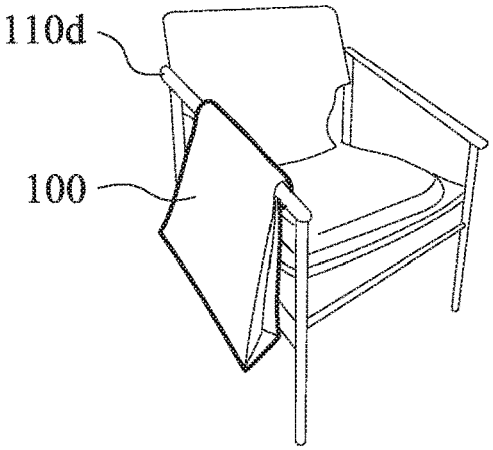
FIG. 9 is a schematic view of a patting bag structure connected to a fourth work element according to one example embodiment of the present disclosure.
Figure 10:
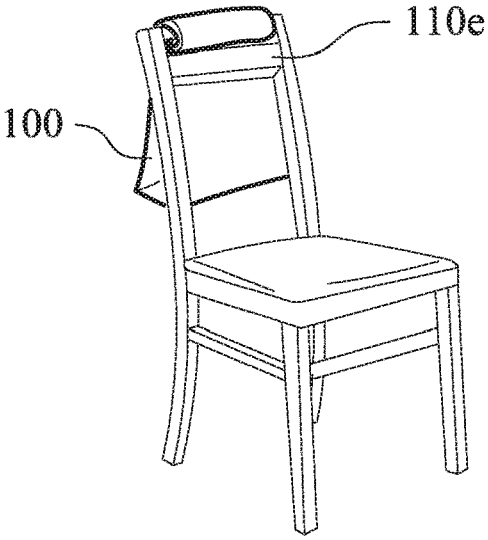
FIG. 10 is a schematic view of a patting bag structure connected to a fifth work element according to one example embodiment of the present disclosure.
Figure 11:
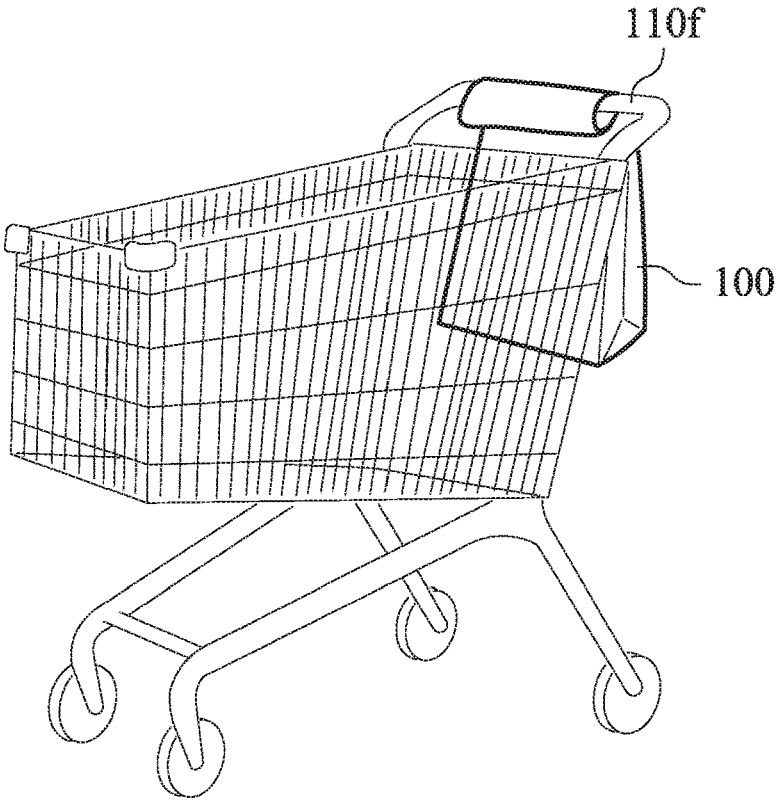
FIG. 11 is a schematic view of a patting bag structure connected to a sixth work element according to one example embodiment of the present disclosure.
Figure 12:
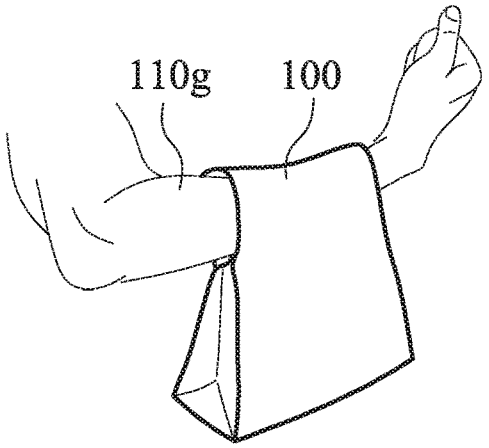
FIG. 12 is a schematic view of a patting bag structure connected to a seventh work element according to one example embodiment of the present disclosure.
Figure 13:
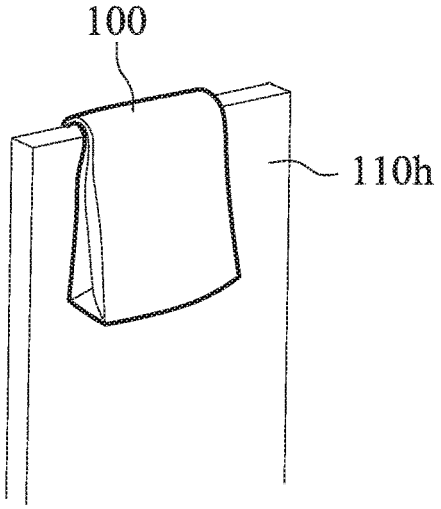
FIG. 13 is a schematic view of a patting bag structure connected to an eighth work element according to one example embodiment of the present disclosure.

Please refer to FIG. 1 and FIG. 6 to FIG. 13. FIG. 1 is a schematic view of a patting bag structure 100 according to a first embodiment of the present disclosure. FIG. 6 is a schematic view of the patting bag structure 100 of FIG. 1 connected to a first work element 110*a*. FIG. 7 is a schematic view of the patting bag structure 100 of FIG. 1 connected to a second work element 110*b*. FIG. 8 is a schematic view of the patting bag structure 100 of FIG. 1 connected to a third work element 110*c*. FIG. 9 is a schematic view of the patting bag structure 100 of FIG. 1 connected to a fourth work element 110*d*. FIG. 10 is a schematic view of the patting bag structure 100 of FIG. 1 connected to a fifth work element 110*e*. FIG. 11 is a schematic view of the patting bag structure 100 of FIG. 1 connected to a sixth work element 110*f*. FIG. 12 is a schematic view of the patting bag structure 100 of FIG. 1 connected to a seventh work element 110*g*. FIG. 13 is a schematic view of the patting bag structure 100 of FIG. 1 connected to an eighth work element 110*h*. As shown in FIG. 1 and FIGS. 6 to 13, the patting bag structure 100 can be furled when an external force is applied thereto, and the patting bag structure 100 is furled and connected to a work element. The work element can be the first work element 110*a*, the second work element 110*b*, the third work element 110*c*, the fourth work element 110*d*, the fifth work element 110*e*, the sixth work element 110*f*, the seventh work element 110*g* or the eighth work element 110*h*. The patting bag structure 100 includes a bag body 200 and an elastic furling element 300.

The bag body 200 includes an opening 210, a patting portion 220 and a housing portion 230. The patting portion 220 is connected to the housing portion 230, and the opening 210 is connected to the housing portion 230 by the patting portion 220. In detail, the opening 210 includes an opening direction, and the bag body 200 further includes a first bag portion 240, a second bag portion 250, a first side-bag portion 260, a second side-bag portion 270 and a bag bottom portion 280, wherein the elastic furling element 300 is disposed on the first bag portion 240.

The opening direction of the opening 210 extends from the bag bottom portion 280 to the opening 210. In one embodiment, the elastic furling element 300 is disposed on the first bag portion 240 by an adhesive method or an engaging method. The second bag portion 250 corresponds to the first bag portion 240, and an area of the first bag portion 240 is equal to an area of the second bag portion 250. The first side-bag portion 260 is connected between the first bag portion 240 and the second bag portion 250, and the first side-bag portion 260 is furled along with the first bag portion 240. The second side-bag portion 270 is connected between the first bag portion 240 and the second bag portion 250, and the second side-bag portion 270 is furled along with the first bag portion 240. The bag bottom portion 280 is connected to the first bag portion 240, the second bag portion 250, the first side-bag portion 260 and the second side-bag portion 270. The bag body 200 can be made of a soft material such as silicone, polyurethane (TPU) or leather. Furthermore, a surface of the bag body 200 can be coated with a reflective material. Therefore, it is favorable for the bag body 200 to be identified and found at night or in the dark easily, so that the safety of a user can be increased.

The elastic furling element 300 is disposed on the patting portion 220 of the bag body 200. The elastic furling element 300 is furled when the external force is applied thereto, so that the patting portion 220 is furled together with the elastic furling element 300 so as to disconnect the opening 210 from the housing portion 230. In detail, the external force can be a flapping force. The elastic furling element 300 has a long-strip shape and includes a longitudinal axis, and the opening direction of the opening 210 is parallel to the longitudinal axis. The elastic furling element 300 can be made of a metal material, and in one embodiment, the metal material is manganese. Furthermore, the elastic furling element 300 being furled can be straightening by another external force so as to recover its original shape. Therefore, the use thereof is very convenient and rapid to the user.

The first work element 110*a* of FIG. 6 is a top tube of a bicycle. The second work element 110*b* of FIG. 7 is a horizontal tube of a baby carriage. The third work element 110*c* of FIG. 8 is a horizontal tube of a luggage. The fourth work element 110*d* of FIG. 9 is an armrest of a chair. The fifth work element 110*e* of FIG. 10 is a chair back of a chair. The sixth work element 110*f* of the FIG. 11 is a horizontal tube of a shopping cart. The seventh work element 110*g* of FIG. 12 is an arm, and the eighth work element 110*h* of FIG. 13 is a door. Each of the first work element 110*a*, the second work element 110*b*, the third work element 110*c*, the fourth work element 110*d*, the sixth work element 110*f* and the seventh work element 110*g* has a cylindrical strip shape, and an extending direction of each of the first work element 110*a*, the second work element 110*b*, the third work element 110*c*, the fourth work element 110*d*, the sixth work element 110*f* and the seventh work element 110*g* is perpendicular to the longitudinal axis of the elastic furling element 300. Therefore, the elastic furling element 300 of the patting bag structure 100 of the present disclosure can be furled by patting the opening 210 thereof after using for storage so as to seal the opening 210 quickly. Furthermore, the patting bag structure 100 of the present disclosure can be abutted against to and positioned on a wide variety of work elements elastically by the elastic furling element 300 of the furled portion thereof. Therefore, the patting bag structure 100 of the present disclosure not only has a simple structure but also is easy to use, so that it is favorable for resolving the conventional problems that the bag body should be equipped with an additional sealing structure and other devices are needed so as to help the loading of the bag body.

Figure 2:
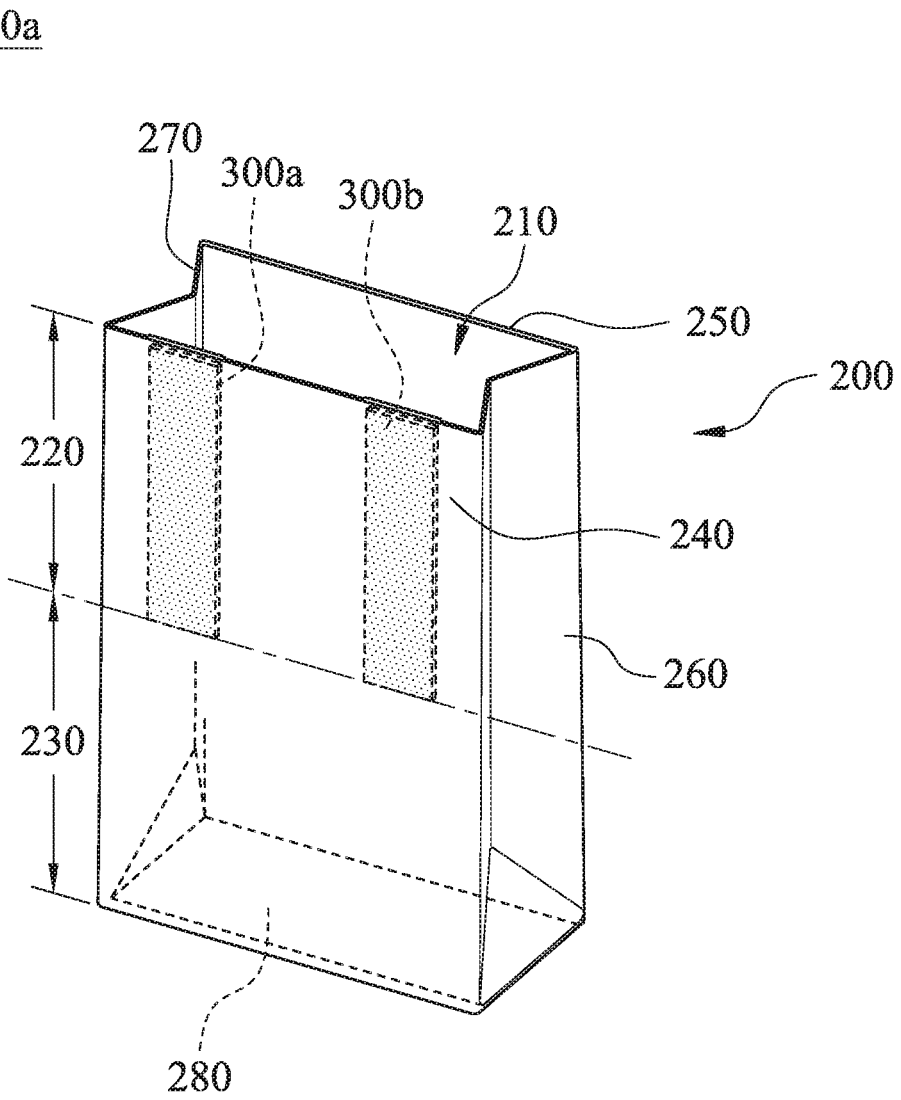
FIG. 2 is a perspective view of a patting bag structure according to one example embodiment of the present disclosure.

Please refer to FIG. 1, FIG. 2 and FIGS. 6 to 13. FIG. 2 is a schematic view of a patting bag structure 100*a* according to a second embodiment of the present disclosure. The patting bag structure 100*a* is furled when an external force is applied thereto, and the patting bag structure 100*a* is furled and connected to a work element. The patting bag structure 100*a* includes a bag body 200, an elastic furling element 300*a* and an elastic furling element 300*b*.

In the embodiment of FIG. 2, the structure of the bag body 200 is the same as that of the bag body 200 of FIG. 1, so that the detail thereof is not described thereto. In particular, the patting bag structure 100*a* according to the embodiment of FIG. 2 further includes two elastic furling elements 300*a*, 300*b*. Both of the elastic furling element 300*a* and the elastic furling element 300*b* are disposed on the patting portion 220 of the bag body 200, and the elastic furling element 300*a* and the elastic furling element 300*b* are arranged parallel to each other and spaced apart from each other. The elastic furling element 300*a* and the elastic furling element 300*b* are furled when the external force is applied thereto, and the patting portion 220 is furled together with the elastic furling element 300*a* and the elastic furling element 300*b* so as to disconnect the opening 210 from the housing portion 230. In other words, the elastic furling element 300*a* and the elastic furling element 300*b* are simultaneously furled when the external force is applied thereto, and the patting portion 220 of the bag body 200 is furled correspondingly so as to close the opening 210 adjacent to the patting portion 220 and then make the housing portion 230 to form a sealed space. Therefore, the elastic furling element 300*a* and the elastic furling element 300*b* of the patting bag structure 100*a* of the present disclosure can be furled by patting the opening 210 thereof after using for storage so as to seal the bag body 200 quickly. Furthermore, the patting bag structure 100*a* of the present disclosure can be abutted against to and positioned on a wide variety of work elements elastically by the elastic furling element 300*a* and the elastic furling element 300*b* of the furled portion thereof. Therefore, the patting bag structure of the present disclosure not only has a simple structure but also is easy to use, so that it is favorable for resolving the conventional problems that the bag body should be equipped with an additional sealing structure and other devices are needed so as to help the loading of the bag body.

Figure 3:
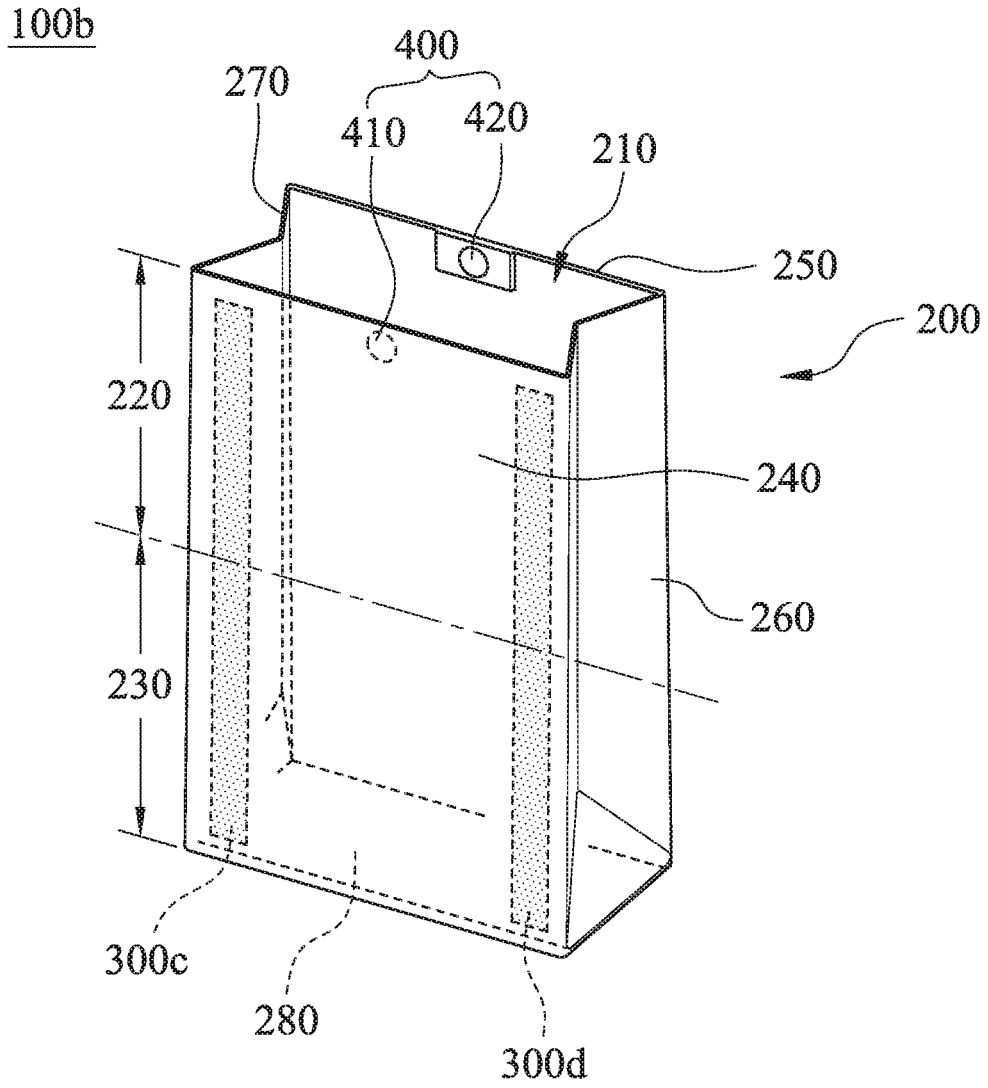
FIG. 3 is a perspective view of a patting bag structure according to one example embodiment of the present disclosure.
Figure 4:
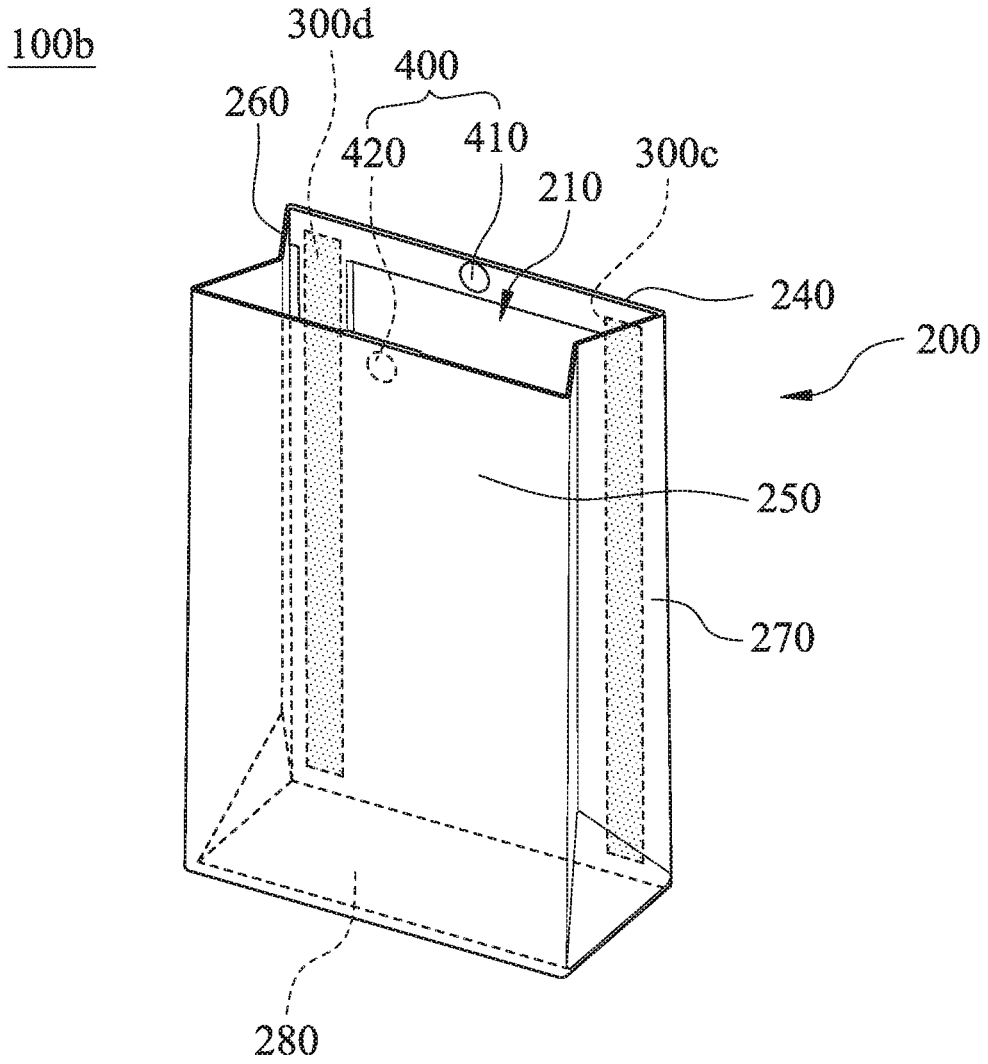
FIG. 4 is a perspective view of a patting bag structure according to one example embodiment of the present disclosure.
Figure 5:
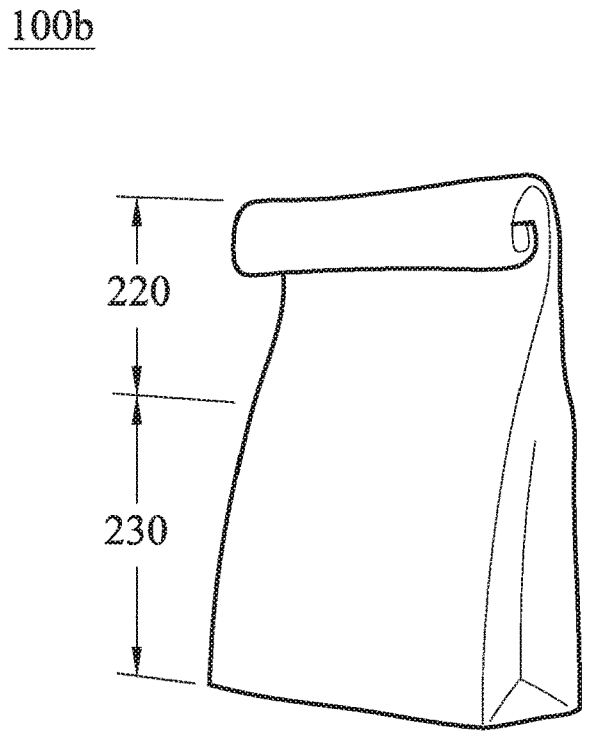
FIG. 5 is a schematic view of the furled patting bag structure of FIG. 3.

Please refer to FIG. 2 to FIG. 13. FIG. 3 is a first schematic view of a patting bag structure 100*b* according to a third embodiment of the present disclosure. FIG. 4 is a second schematic view of a patting bag structure 100*b* according to the third embodiment of the present disclosure. FIG. 5 is a furling schematic view of the patting bag structure 100*b* of FIG. 3. As shown in FIG. 2 to FIG. 13, the patting bag structure 100*b* is furled when an external force is applied thereto. The patting bag structure 100*b* includes a bag body 200, an elastic furling element 300*c*, an elastic furling element 300*d* and an engaging set 400.

In the embodiment of FIG. 3, the structure of the bag body 200 is the same as that of the bag body 200 of FIG. 1, so that the detail thereof is not described thereto.

In particular, the patting bag structure 100*b* according to the embodiment of FIG. 3 further includes two elastic furling elements 300*c*, 300*d* and the engaging set 400. Each of the elastic furling elements 300*c* and 300*d* includes a patting section (reference number is omitted) and a housing section (reference number is omitted), wherein the patting section is connected to the housing section, and the patting section and the housing section are disposed on the patting portion 220 and the housing portion 230, respectively. The patting section is furled when the external force is applied thereto, and the patting portion 220 is furled together with the patting section so as to disconnect the opening 210 from the housing portion 230. In other words, the patting section of each of the elastic furling elements 300*c* and 300*d* is configured to be patted and the be furled correspondingly, and the housing section is configured to accommodate articles and support the shape thereof. Furthermore, the engaging set 400 is disposed on the patting portion 220 and adjacent to the opening 210. The engaging set 400 includes a first engaging element 410 and a second engaging element 420. The first engaging element 410 is disposed on the first bag portion 240. The second engaging element 420 is disposed on the second bag portion 250 and corresponds to the first engaging element 410. The second engaging element 420 is connected to the first engaging element 410 detachably so as to partially close the opening 210. Moreover, it is worth to be noted that the engaging set 400 also can be disposed on the bag body 200 of the patting bag structure 100 of FIG. 1 or on the bag body 200 of the patting bag structure 100*a* of FIG. 2 so as to partially close the opening 210 by the engaging set 400 and prevent the articles accommodated in the bag body 200 from falling or leaking out. Therefore, the patting section of the elastic furling element 300*c* and the elastic furling element 300*d* of the patting bag structure 100*b* of the present disclosure can be furled by patting the opening 210 thereof after using for storage so as to seal the opening 210 of the bag body 200 quickly. Furthermore, the patting bag structure 100*b* of the present disclosure can be abutted against to and positioned on a wide variety of work elements elastically by the elastic furling element 300*c* and the elastic furling element 300*d* of the furled portion thereof. Therefore, the patting bag structure of the present disclosure not only has a simple structure but also is easy to use, so that it is favorable for resolving the conventional problems that the bag body should be equipped with an additional sealing structure and other devices are needed so as to help the loading of the bag body.

Figure 14:
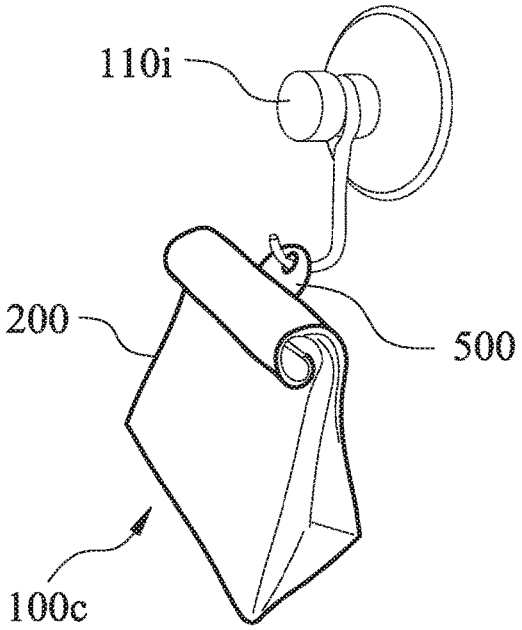
FIG. 14 is a schematic view of a patting bag structure connected to a ninth work element according to one example embodiment of the present disclosure.

Please refer to FIG. 2 and FIG. 14. FIG. 14 is a schematic view of a patting bag structure 100*c* connected to a ninth work element 110*i*. The patting bag structure 100*c* includes a bag body 200, two elastic furling elements (reference numbers are not shown) and a connecting element 500. In the illustrated embodiment, the structures of the bag body 200 and the two elastic furling elements are the same as those of the bag body 200, the elastic furling element 300*a* and the elastic furling element 300*b* of FIG. 2, respectively, so that the detail thereof is not described thereto. The connecting element 500 is connected to an outer portion of the bag body 200 and includes a hole (reference number is omitted), and the hole is configured to pass through a hook element of the work element 110*i* correspondingly. The connecting element 500 is disposed on the housing portion 230. When the bag body 200 is furled, the connecting element 500 is still exposed and located on the outer portion of the bag body 200 so as to pass through the hook element. Therefore, the elastic furling element of the patting bag structure 100*c* of the present disclosure can be furled by patting the opening (not shown) thereof after using for storage so as to seal the bag body 200 quickly, and the patting bag structure 100*c* of the present disclosure also has a simple structure and is easy to use. Furthermore, by the arrangement of the connecting element 500, the patting bag structure 100*c* of the present disclosure can be connected to a hook element or a tubular element with thin structure, so that the application range thereof can be further increased.

Figure 15:
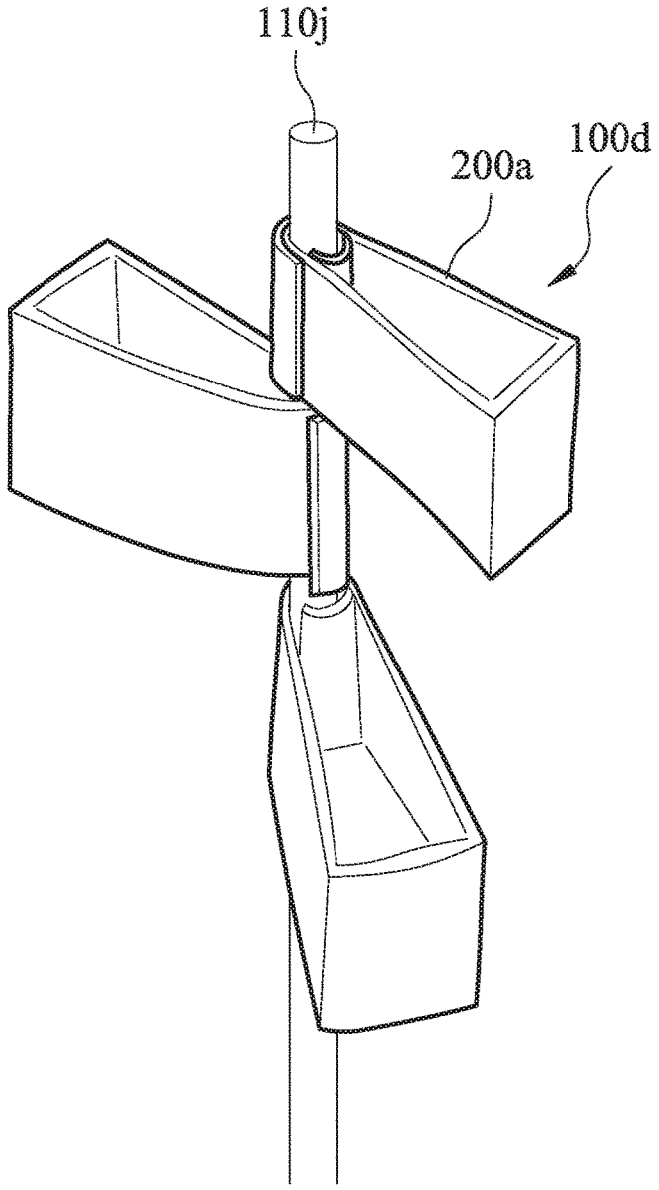
FIG. 15 is a schematic view of a patting bag structure connected to a tenth work element according to one example embodiment of the present disclosure.

Please refer to FIG. 2 and FIG. 15. FIG. 15 is a schematic view of a patting bag structure 100*d* connected to a tenth work element 110*j*. The patting bag structure 100*d* includes a bag body 200*a* and two elastic furling elements (reference numbers are not shown). In the illustrated embodiment, the structures of the elastic furling elements are the same as those of the elastic furling element 300*a* and the elastic furling element 300*b* of FIG. 2, so that the detail thereof is not described thereto. Furthermore, the bag body 200*a* is similar to the bag body 200 of FIG. 2, and the only difference therebetween is that the bag body 200*a* does not include the second side-bag portion 270. In detail, as shown in FIG. 15, because the bag body 200*a* is without the second side-bag portion 270, the bag body 200*a* can have a housing hole and form as a housing box. As shown in FIG. 15, the tenth work element 110*j* is a straight bar, and three bag bodies 200*a* are furled and positioned on the straight bar. The vertical position and the horizontal position of the three bag bodies 200*a*, respectively, are different. Therefore, the elastic furling element of the patting bag structure 100*d* of the present disclosure can be furled by patting the opening (not shown) thereof after using for storage so as to seal the bag body 200*a* and position on the tenth work element 110*j* quickly, and the patting bag structure 100*d* of the present disclosure also has a simple structure and is easy to use. Furthermore, the vertical space can be more effectively used by the combination of a plurality of the patting bag structure 100*d* formed as a plurality of housing boxes and the tenth work element 110*j*.

Figure 16:
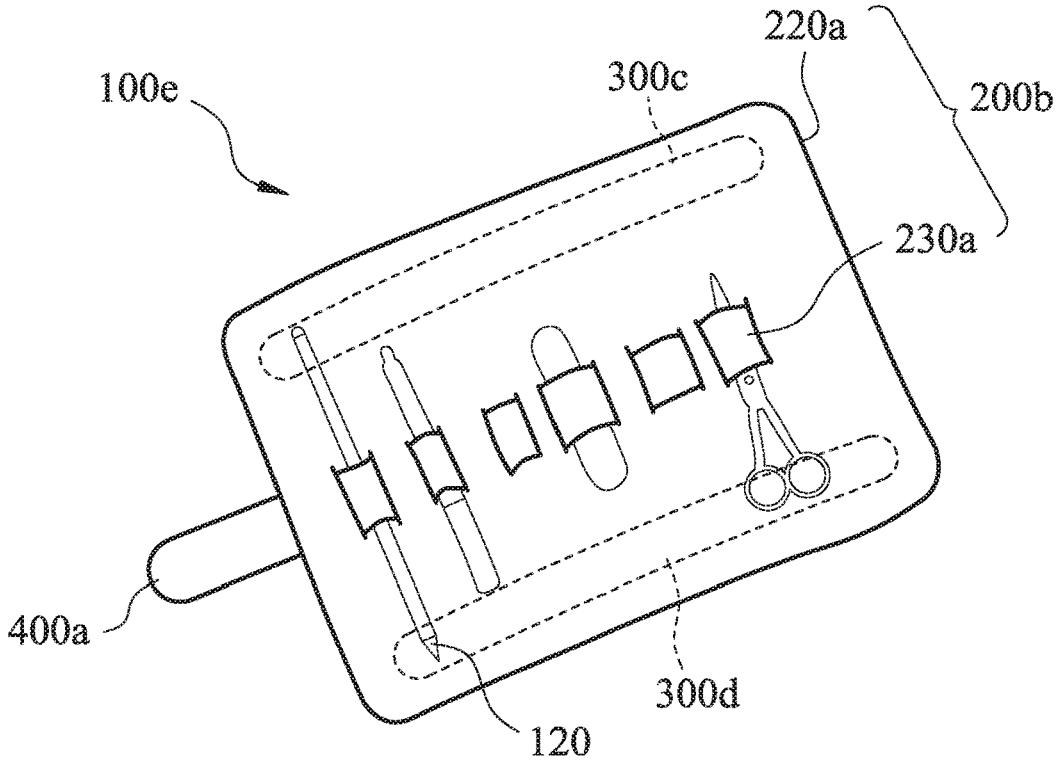
FIG. 16 is a schematic view of a patting bag structure according to one example embodiment of the present disclosure.
Figure 17:
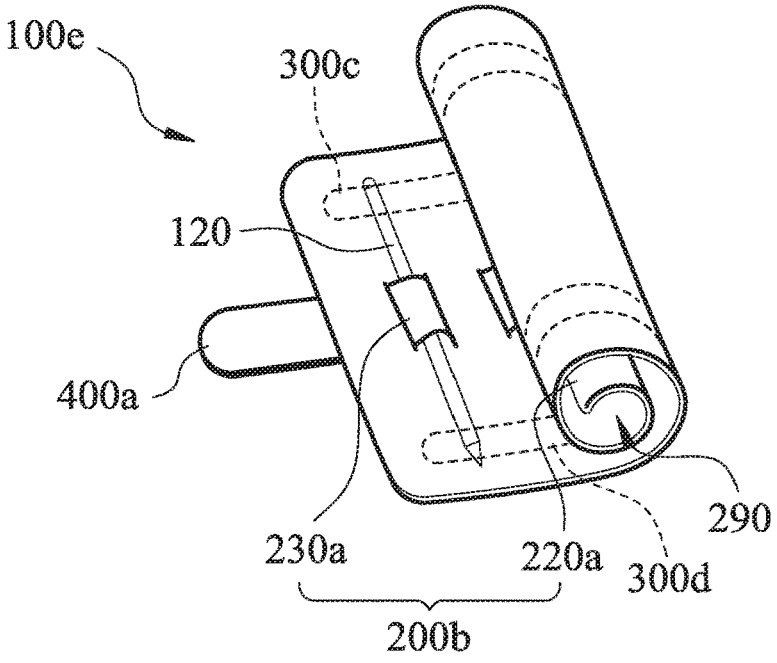
FIG. 17 is a schematic view of the patting bag structure of FIG. 16 in a furled state.

FIG. 16 is a schematic view of a patting bag structure 100*e* according to a sixth embodiment of the present disclosure. FIG. 17 is a furling schematic view of the patting bag structure 100*e* of FIG. 16. As shown in FIGS. 16 and 17, the patting bag structure 100*e* is furled when an external force is applied thereto. The patting bag structure 100*e* includes a bag body 200*b*, an elastic furling element 300*c*, an elastic furling element 300*d* and an engaging set 400*a*.

The bag body 200*b* includes a patting portion 220*a* and a housing portion 230*a*, and the patting portion 220*a* is connected to the housing portion 230*a*. The elastic furling element 300*c* and the elastic furling element 300*d* are disposed on the patting portion 220*a* of the bag body 200*b*. The elastic furling element 300*c* and the elastic furling element 300*d* are furled when the external force is applied thereto, and the patting portion 220*a* is furled together with the elastic furling element 300*c* and the elastic furling element 300*d* so as to form a furling space 290, and the housing portion 230*a* is located in the furling space 290. Furthermore, a number of the housing portion 230*a* can be more than one. As shown in FIG. 16, when the patting portion 220*a* is arranged flat, each of the housing portions 230*a* can be used to accommodate one of the articles 120. For example, a pen can pass through a hole of the housing portion 230*a* so as to be positioned between the patting portion 220*a* and the housing portion 230*a*. Furthermore, the engaging set 400*a* can be a hook and loop fastener, a magnetic strip or a buckle. As shown in FIG. 17, when the patting portion 220*a* is furled, the patting bag structure 100*e* can be positioned and formed as a fixed cylindrical shape by the engaging set 400*a* so as to prevent the article 120 from falling due to the spreading out of the patting portion 220*a*. Therefore, the patting bag structure 100*e* of the present disclosure can be used to accommodate a variety of articles 120 in the furling space 290 by the patting portion 220*a* being furled. The patting bag structure 100*e* of the present disclosure not only has a simple structure and is convenient to use, but it is favorable for resolving the conventional problems that the bag body is needed to furl by hands.

According to the aforementioned embodiments, the patting bag structure of the present disclosure has advantages listed as follows. First, the elastic furling element of the patting bag structure can be furled by patting the opening thereof after using for storage so as to seal the bag body quickly, and the patting bag structure of the present disclosure can be furled and connected to a variety of work elements by the patting section being furled. The patting bag structure of the present disclosure not only has a simple structure and is easy to use, but it is favorable for resolving the conventional problems that the bag body should be equipped with an additional sealing structure and other devices are needed so as to help the loading of the bag body. Second, the opening of the patting bag structure of the present disclosure can be partially closed by the engaging set so as to prevent the articles accommodated in the bag body from falling or leaking out. Third, the elastic furling element being furled can be straightening by an external force so as to recover its original shape, and the use thereof is very convenient and rapid to the user. Fourth, the patting bag structure of the present disclosure can be connected to a hook element or a tubular element with thin structure, so that the application range thereof can be further increased. Fifth, the vertical space can be more effectively used by a plurality of the patting bag structure formed as a plurality of housing boxes. Sixth, the patting bag structure of the present disclosure can be used to accommodate a variety of articles in the furling space by the patting portion being furled. The patting bag structure of the present disclosure not only has a simple structure and is convenient to use, but it is favorable for resolving the conventional problems that the bag body is needed to furl by hands.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A storage system comprising a patting bag structure capable of being furled when an external force is applied thereto and a bar-shaped structure, the patting bag structure comprising:

a bag body comprising a first opening, a second opening, a patting portion, and a housing portion, wherein the patting portion is connected to the housing portion, the first opening is connected to a top of the housing portion by the patting portion, and the second opening is a housing hole at a side of the housing portion;

and at least one elastic furling element disposed on the patting portion of the bag body, wherein the at least one elastic furling element is furled when the external force is applied thereto, and the patting portion is furled together with the at least one elastic furling element so as to disconnect the first opening from the housing portion, wherein when the patting portion is furled together with the at least one elastic furling element, the furled patting portion is abutted against and grips on the bar-shaped structure, and the second opening remains opened on the side of the housing portion.

2. The storage system of claim 1, wherein the first opening comprises an opening direction, the at least one elastic furling element has a long-strip shape and comprises a longitudinal axis, and the opening direction is parallel to the longitudinal axis.

3. The storage system of claim 2, wherein the furled patting portion grips on the bar-shaped structure elastically by the at least one elastic furling element.

4. The storage system of claim 1, wherein the bag body further comprises:

a first bag portion, wherein the at least one elastic furling element is disposed on the first bag portion;

a second bag portion corresponding to the first bag portion;

a first side-bag portion connected between the first bag portion and the second bag portion;

the second opening extending between the first bag portion and the second bag portion; and a bag bottom portion connected to the first bag portion, the second bag portion, the first side-bag portion and the second opening.

5. The storage system of claim 1, wherein the at least one elastic furling element includes two or more elastic furling elements, and the elastic furling elements are arranged parallel to each other and spaced apart from each other.

6. The storage system of claim 5, wherein the first opening comprises an opening direction, each of the elastic furling elements has a long-strip shape and comprises a longitudinal axis, and the opening direction is parallel to the longitudinal axis.

7. The storage system of claim 6, wherein the patting bag structure is furled and connected to a bar-shaped structure, and the patting bag structure is abutted against and positioned on the bar-shaped structure elastically by the elastic furling elements.

8. The storage system of claim 5, wherein the bag body further comprises:

a first bag portion, wherein the elastic furling elements are disposed on the first bag portion;

a second bag portion corresponding to the first bag portion;

a first side-bag portion connected between the first bag portion and the second bag portion;

the second opening extending between the first bag portion and the second bag portion; and a bag bottom portion connected to the first bag portion, the second bag portion, the first side-bag portion and the second opening.

9. A storage system comprising a patting bag structure capable of being furled when an external force is applied thereto and a bar-shaped structure, the patting bag structure comprising:

a bag body comprising a first opening, a second opening, a patting portion, and a housing portion, wherein the patting portion is connected to the housing portion, the first opening is connected to a top of the housing portion by the patting portion, and the second opening is a housing hole at a side of the housing portion;

and at least one elastic furling element comprising a patting section and a housing section, wherein the patting section is connected to the housing section, the patting section and the housing section are disposed on the patting portion and the housing portion, respectively, the patting section is furled when the external force is applied thereto, and the patting portion is furled together with the patting section so as to disconnect the first opening from the housing portion, wherein when the patting portion is furled together with the patting section, the furled patting portion is abutted against and grips on the bar-shaped structure, and the second opening remains opened on the side of the housing portion.

10. The storage system of claim 9, wherein the first opening comprises an opening direction, the at least one elastic furling element has a long-strip shape and comprises a longitudinal axis, and the opening direction is parallel to the longitudinal axis.

11. The storage system of claim 10, wherein the furled patting portion grips on the bar-shaped structure elastically by the at least one the elastic furling element.

12. The storage system of claim 9, wherein the bag body further comprises:

a first bag portion, wherein the at least one elastic furling element is disposed on the first bag portion;

a second bag portion corresponding to the first bag portion;

a first side-bag portion connected between the first bag portion and the second bag portion;

the second opening extending between the first bag portion and the second bag portion; and a bag bottom portion connected to the first bag portion, the second bag portion, the first side-bag portion and the second opening.

* * * * *